US007091673B2

(12) United States Patent
Okura et al.

(10) Patent No.: US 7,091,673 B2
(45) Date of Patent: Aug. 15, 2006

(54) DISCHARGE LAMP LIGHTING DEVICE

(75) Inventors: Susumu Okura, Tokyo (JP); Takashi Ohsawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 3 days.

(21) Appl. No.: 10/488,086

(22) PCT Filed: Jun. 30, 2003

(86) PCT No.: PCT/JP03/08300

§ 371 (c)(1),
(2), (4) Date: Mar. 1, 2004

(87) PCT Pub. No.: WO2004/006632

PCT Pub. Date: Jan. 15, 2004

(65) Prior Publication Data

US 2005/0088114 A1 Apr. 28, 2005

(30) Foreign Application Priority Data

Jul. 2, 2002 (JP) ..... 2002-193443

(51) Int. Cl.
*H05B 37/02* (2006.01)

(52) U.S. Cl. ..... 315/291; 315/308

(58) Field of Classification Search ..... 315/307, 315/291, 360, 289, 362, 224, DIG. 5, DIG. 7, 315/308, 209 R, 297, 219, 225
See application file for complete search history.

(56) References Cited

U.S. PATENT DOCUMENTS 4,952,848 A * 8/1990 Erhardt ..... 315/307
5,481,163 A 1/1996 Nakamura et al.
6,452,345 B1 * 9/2002 Okura ..... 315/307
6,486,620 B1 * 11/2002 Ito et al. ..... 315/308
6,583,587 B1 * 6/2003 Ito et al. ..... 315/308
6,597,131 B1 * 7/2003 Ito et al. ..... 315/308
6,624,594 B1 * 9/2003 Takeda et al. ..... 315/219
6,794,832 B1 * 9/2004 Yamamoto et al. ..... 315/307

FOREIGN PATENT DOCUMENTS

| | | | |
|---|---|---|---|
| JP | 04-272696 | A | 9/1992 |
| JP | 04-342988 | A | 11/1992 |
| JP | 05-205888 | A | 8/1993 |
| JP | 06-045081 | A | 2/1994 |
| JP | 7-176388 | A | 7/1995 |
| JP | 08-222381 | A | 8/1996 |
| JP | 09-237691 | A | 9/1997 |
| JP | 1186795 | A | 3/1999 |
| JP | 11-317298 | A | 11/1999 |
| JP | 200293368 | A | 3/2002 |
| JP | 2002110099 | A | 4/2002 |
| JP | 2003-151787 | A | 5/2003 |

* cited by examiner

*Primary Examiner*—Thuy V. Tran
*Assistant Examiner*—Chuc Tran
(74) *Attorney, Agent, or Firm*—Sughrue Mion, PLLC

(57) ABSTRACT

A discharge bulb ballast has a control circuit (11) that includes a turning point detecting unit (101) for detecting a turning point at which a bulb voltage starts rising after switching on a discharge bulb (7). Immediately after switching on the discharge bulb (7), a power control unit (102) carries out control in such a manner that the discharge bulb (7) is supplied with first power. When the turning point detecting unit (101) detects that the voltage of the discharge bulb (7) exceeds the turning point, the power control unit (102) supplies the discharge bulb (7) with second power less than the first power.

11 Claims, 8 Drawing Sheets

DISCHARGE LAMP LIGHTING DEVICE

This Application is a National Phase Application under U.S.C. 371 claiming the benefit of PCT/JP03/08300 filed on Jun. 30, 2003, which has priority based on Japan Application No. 2002-193443 filed on Jul. 2, 2002.

TECHNICAL FIELD

The present invention relates to a discharge bulb ballast used for headlights of automobiles, for illumination lamps of indoor and outdoor facilities, warehouses and factories, and for streetlights.

BACKGROUND ART

Generally, discharge bulbs, particularly high-intensity discharge bulbs (HID bulbs) such as metal halide bulbs, high-pressure sodium bulbs and mercury bulbs have advantages of large luminous flux, high lamp efficiency and long life. Accordingly, they have been used as illumination lamps of indoor and outdoor facilities, warehouses and factories, and as streetlights. In particular, they are now employed as headlights of vehicles such as automobiles.

An ordinary HID bulb utilizes gases such as xenon, metal halides and mercury in the bulb to stabilize its interelectrode voltage (bulb voltage) at a specified voltage during discharging and lighting, thereby stabilizing its luminous quantity. For example, a mercury-in-bulb, onboard 35 W HID bulb (the so-called D1 and D2 types are typical) can stabilize the bulb voltage at 85 V during stable lighting. Because of these advantages, most of the HID bulbs utilize mercury in general under the present circumstances.

However, since the mercury, which is sealed into the bulb to stabilize the bulb voltage, increases the environmental load, HID bulbs without using mercury have been studied, as disclosed in Japanese patent application laid-open No. 11-86795/1999, No. 2002-110099, No. 2002-93368 and so on. Likewise, as for the onboard HID bulbs, HID bulbs without using mercury (the so-called D3 and D4 types are typical) have been proposed.

The onboard HID bulbs without using mercury (D3 and D4 types) utilize zinc or indium instead of adding mercury. The zinc or indium, however, requires more amount of heat for evaporation than mercury.

In addition, as for 35 W HID bulbs with the same rating as the conventional HID bulbs (D1 and D2 types), although the D1 and D2 type HID bulbs have the bulb voltage of 85 V during the stable lighting, the D3 and D4 type HIDs have the bulb voltage of 42 V during the stable lighting.

Furthermore, the behavior immediately after switching on the light is different. For example, the voltage immediately after turning on the HID bulb is determined by the components and pressure of the gases in the HID bulbs. As for the conventional HID bulb using the mercury, the mercury, which quickly becomes gaseous, brings about a voltage drop. Thus, the HID bulb increases the voltage rapidly, and the gaseous mercury emits light by itself, thereby increasing the luminous quantity quickly. In addition, regulating the output power to be supplied to the HID bulb in accordance with the HID bulb voltage or lighting elapsed time makes is possible to produce a constant luminous quantity.

However, as for the HID bulb without using the mercury, since it does not include mercury for bringing about the voltage drop, only a xenon gas is present in the HID bulb until the metal halides vaporize immediately after switching on the light. Therefore the HID bulb without using the mercury has a nearly constant, low voltage immediately after switching on the light because of the voltage drop due to only the xenon gas. In addition, since the quantity of light is limited to that emitted by the xenon gas, the luminous quantity is comparatively low for the power at turn-on.

Consequently, when the HID bulb such as the HID bulb without using the mercury (D3 and D4), which requires a large amount of heat until the metals in the HID bulb vaporize, is turned on by a discharge bulb ballast for the conventional HID bulb containing the mercury, the output power can attenuate before the metal halides evaporate, that is, before the metal halides start to emit light. As a result, the HID bulb cannot be supplied with appropriate power, and takes a considerable time until it produces a sufficient luminous quantity. In particular, since the onboard headlights require sharp start-up of the luminous quantity, it is difficult for this purpose to use the conventional discharge bulb ballast. In addition, when fillers vaporize, the luminous quantity increases sharply, which presents a problem in that the luminous quantity at the lighting up of the discharge bulb is unstable.

DISCLOSURE OF THE INVENTION

According to one aspect of the present invention, there is provided a discharge bulb ballast including a power supply circuit for supplying power to a discharge bulb, an ignition circuit for applying a high voltage pulse to start discharge of the discharge bulb, and a control circuit for controlling power supplied by the power supply circuit and ignition circuit, the control circuit of the discharge bulb ballast comprising: a turning point detecting unit for detecting a turning point at which a voltage of the discharge bulb starts to rise after the discharge bulb is switched on; and a power control unit for supplying first power after the discharge bulb is switched on, and for supplying second power lower than the first power when the turning point detecting unit detects the turning point.

Thus, it offers an advantage of being able to provide a discharge bulb ballast capable of producing sufficient luminous quantity quickly and emitting appropriate luminous quantity when fillers vaporize, even when it is applied to a discharge bulb such as a mercury-less discharge bulb that uses metals requiring a large amount of heat to vaporize as the fillers.

In the discharge bulb ballast in accordance with the present invention, the turning point detecting unit may comprise a differentiating circuit.

Thus, it offers an advantage of being able to implement a discharge bulb ballast applicable to discharge bulbs without using mercury, which are used as the onboard headlights requiring the sharp start-up of the luminous quantity and stable lighting.

In the discharge bulb ballast in accordance with the present invention, the turning point detecting unit may define as a stable voltage a voltage of the discharge bulb in a stable lighting state at rated power, and set a voltage value having a specified ratio to the stable voltage as the turning point, wherein when the turning point detecting unit detects the turning point, the power control unit may start attenuation of output power, and gradually reduce an output power to the rated power.

Thus, it can set the optimum turning point for the individual discharge bulbs, even if their voltages have variations due to the individual difference. As a result, it offers an advantage of being able to implement the discharge bulb ballast applicable to the discharge bulbs without using the mercury, which are used as the onboard headlights requiring the sharp start-up of the luminous quantity and stable lighting.

In the discharge bulb ballast in accordance with the present invention, the turning point detecting unit may employ as the turning point a voltage value obtained by adding a predetermined voltage to a voltage of the discharge bulb that is lighting at a constant voltage immediately after switching on the light, wherein when the turning point detecting unit detects the turning point, the power control unit may start attenuation of output power, and gradually reduce an output power to rated power.

Thus, it can set the optimum turning point for the individual discharge bulbs, even if their voltages have variations due to the individual difference. As a result, it offers an advantage of being able to implement the discharge bulb ballast applicable to the discharge bulbs without using the mercury, which are used as the onboard headlights requiring the sharp start-up of the luminous quantity and stable lighting.

In the discharge bulb ballast in accordance with the present invention, the turning point detecting unit may detect a lowest voltage among discharge bulb voltages successively detected immediately after switching on the light as a minimum bulb voltage, and employ a voltage value obtained by adding a predetermined voltage to the minimum bulb voltage as the turning point, wherein when the turning point detecting unit detects the turning point, the power control unit may start attenuation of output power, and gradually reduce an output power to rated power.

Thus, it can set the optimum turning point for the individual discharge bulbs, even if their voltages have variations due to the individual difference. As a result, it offers an advantage of being able to implement the discharge bulb ballast applicable to the discharge bulbs without using the mercury, which are used as the onboard headlights requiring the sharp start-up of the luminous quantity and stable lighting. In addition, it offers an advantage that the turning point detecting unit need not store the information such as the previous turning point.

In the discharge bulb ballast in accordance with the present invention, the turning point detecting unit may employ as the turning point a lowest voltage among three voltages consisting of a first voltage having a specified ratio to a stable voltage which is defined as a voltage of the discharge bulb in a stable lighting state at rated power, a second voltage obtained by adding a predetermined voltage to a voltage of the discharge bulb lighting at a constant voltage immediately after switching on the light, and a third voltage obtained by adding a predetermined voltage to a minimum bulb voltage which is detected as a lowest voltage among discharge bulb voltages successively detected immediately after switching on the light, wherein when the turning point detecting unit detects the turning point, the power control unit may start attenuation of output power, and gradually reduce an output power to the rated power.

Thus, it can set the optimum turning point for the individual discharge bulbs, even if their voltages have variations due to the individual difference. As a result, it offers an advantage of being able to implement the discharge bulb ballast applicable to the discharge bulbs without using the mercury, which are used as the onboard headlights requiring the sharp start-up of the luminous quantity and stable lighting. In addition, it offers an advantage of being able to carry out the optimum lighting control in any conditions.

In the discharge bulb ballast in accordance with the present invention, the turning point detecting unit may employ as the turning point a voltage value obtained by adding a predetermined voltage to a voltage of the discharge bulb that is lighting at a constant voltage immediately after switching on the light, and the power control unit may have a voltage of the discharge bulb in a stable lighting state at rated power as a stable voltage, wherein when the turning point detecting unit detects the turning point, the power control unit may start attenuation of output power, and gradually reduce an output power until the discharge bulb reaches the stable phase.

Thus, it can carry out smooth control of the output power in a region in which the discharge bulb voltage is close to the stable voltage. As a result, it offers an advantage of being able to implement a discharge bulb ballast applicable to discharge bulbs without using mercury, which are used as the onboard headlights requiring the sharp start-up of the luminous quantity and stable lighting with little fluctuations.

In the discharge bulb ballast in accordance with the present invention, when the turning point detecting unit detects the turning point, the power control unit may start attenuation of output power, and gradually reduce from the voltage corresponding to the turning point the output power to rated power in accordance with a predetermined relationship between the discharge bulb voltage and the output power.

Thus, it can keep the luminous quantity of the discharge bulb constant during the attenuation control. As a result, it offers an advantage of being able to implement a discharge bulb ballast applicable to HID bulbs without using mercury, which are used as the onboard headlights requiring the sharp start-up of the luminous quantity and stable light emission with little irregularities.

In the discharge bulb ballast in accordance with the present invention, when the turning point detecting unit detects the turning point, the power control unit may start attenuation of output power, and gradually reduce from the voltage corresponding to the turning point the output power to rated power in accordance with a predetermined relationship between a lighting elapsed time and the output power.

Thus, it can provide a discharge bulb ballast applicable to HID bulbs without using mercury, which are used as the onboard headlights requiring the sharp start-up of the luminous quantity and stable light emission with little irregularities. In addition, it offers an advantage of being able to carry out precise attenuation control of the output power in spite of fluctuations in the stable voltage of the discharge bulbs.

In the discharge bulb ballast in accordance with the present invention, the power control unit may hold information on a predetermined relationship between the discharge bulb voltage and output power, and have a discharge bulb voltage value corresponding to the turning point, wherein when the discharge bulb voltage immediately after switching on the light exceeds the discharge bulb voltage value corresponding to the turning point, the power control unit may start attenuation of the output power from a value of the output power corresponding to the discharge bulb voltage in accordance with the information, and gradually reduce an output power to rated power.

Thus, it can carry out precise attenuation control of the output power even when the discharge bulb voltage immediately after switching on the light exceeds the turning point. Accordingly, it can output appropriate power even when the light is turned on in a condition in which the metal halides are evaporated and emitting light because of repetitive switching off and on. As a result, it offers an advantage of being able to implement a discharge bulb ballast applicable to HID bulbs without using mercury, which are used as the onboard headlights requiring the sharp start-up of the luminous quantity and stable light emission with little irregularities.

In the discharge bulb ballast in accordance with the present invention, the power control unit may have a discharge bulb voltage value corresponding to the turning point, information on a relationship between the discharge bulb voltage and a lighting elapsed time, and information on a relationship between the lighting elapsed time and output power, wherein when the discharge bulb voltage immediately after switching on the light exceeds the discharge bulb voltage value corresponding to the turning point, the power control unit may obtain the lighting elapsed time corresponding to the discharge bulb voltage in accordance with the information on the relationship between the discharge bulb voltage and lighting elapsed time, start attenuation of the output power from a value of the output power corresponding to the lighting elapsed time obtained in accordance with the information on the relationship between the lighting elapsed time and output power, and gradually reduce an output power to rated power.

Thus, it can carry out precise attenuation control of the output power even when the discharge bulb voltage immediately after switching on the light exceeds the turning point. Accordingly, it can output appropriate power even when the light is turned on in a condition in which the metal halides are evaporated and emitting light because of repetitive switching off and on. As a result, it offers an advantage of being able to implement a discharge bulb ballast applicable to HID bulbs without using mercury, which are used as the onboard headlights requiring the sharp start-up of the luminous quantity and stable light emission with little irregularities. In addition, it offers an advantage of being able to carry out precise attenuation control of the output power in spite of the fluctuations in the stable voltage of the discharge bulbs.

BEST MODE FOR CARRYING OUT THE INVENTION

The best mode for carrying out the invention will now be described with reference to the accompanying drawings to explain the present invention in more detail.

Embodiment 1

Figure 1:
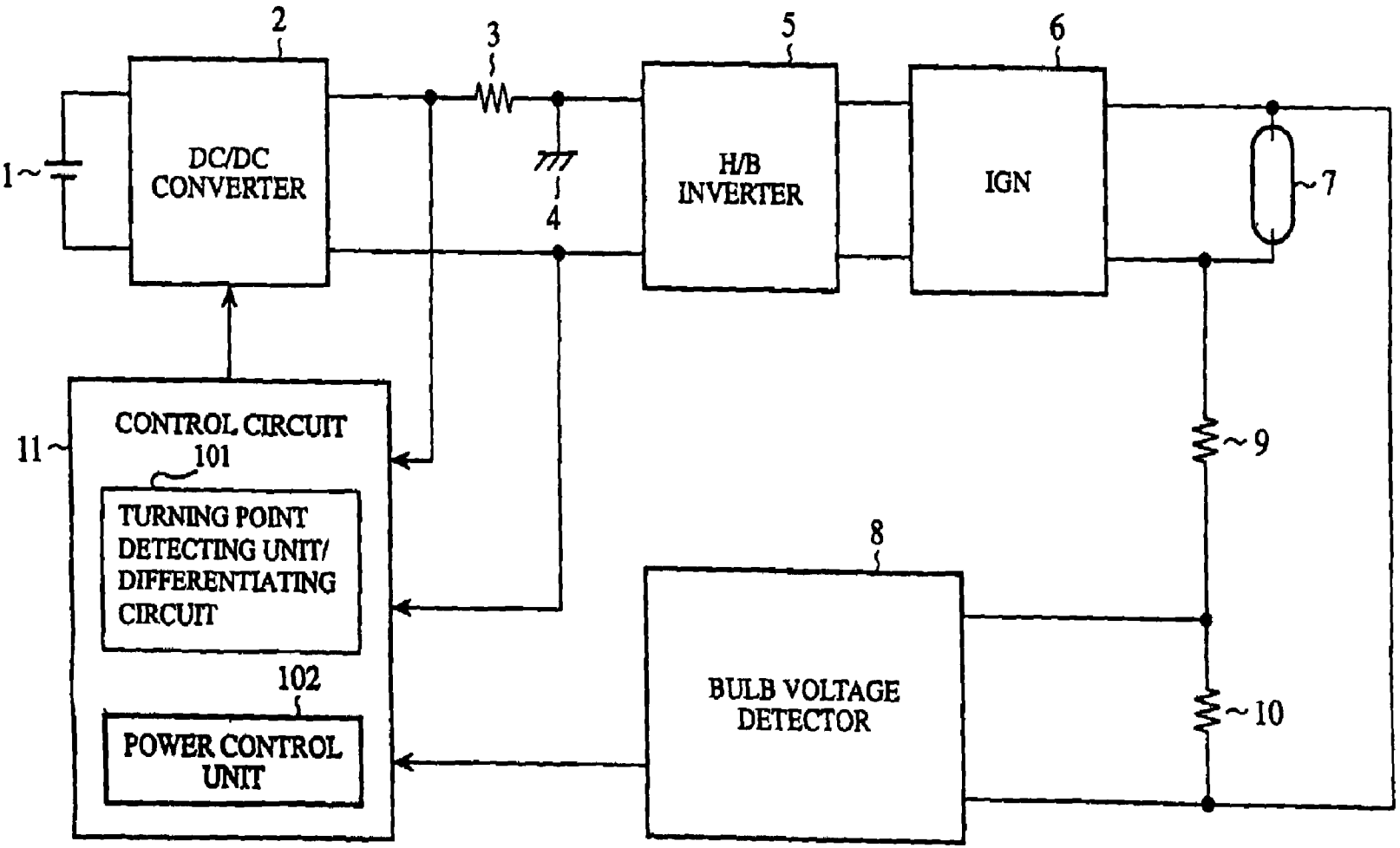
FIG. 1 is a block diagram showing a configuration of an embodiment 1 of a discharge bulb ballast in accordance with the present invention.

FIG. 1 is a block diagram showing a configuration of an embodiment 1 of a discharge bulb ballast in accordance with the present invention.

As shown in FIG. 1, the embodiment 1 of the discharge bulb ballast includes a power supply 1, a DC/DC converter 2, a current detection resistor 3, a ground terminal 4, an H/B inverter 5, an ignition circuit (IGN) 6, an HID bulb 7, a bulb voltage detector 8, resistors 9 and 10, and a control circuit 11.

The power supply 1 consists of a power supply such as an onboard battery. The DC/DC converter 2 is provided to boost the DC power supply voltage of the power supply 1. The current detection resistor 3 is provided to detect the current flowing from the DC/DC converter 2 to the H/B inverter 5, that is, to detect the current flowing into the HID bulb 7. The ground terminal 4 is provided for grounding an end of the current detection resistor 3 to the body of an automobile. The H/B inverter 5 is an inverter that uses an H-bridge circuit for converting the DC output from the DC/DC converter 2 to an AC. The power supply 1, DC/DC converter 2 and H/B inverter 5 constitute a power supply circuit for supplying power to the HID bulb 7.

The ignition circuit 6 is an igniter (IGN) for lighting up the HID bulb 7. The HID bulb 7 is a discharge bulb without using the mercury. The bulb voltage detector 8 is provided to detect the bulb voltage of the HID bulb 7. The detection signal is fed to the control circuit 11. The resistors 9 and 10 constitute a voltage divider for detecting the HID bulb voltage.

The control circuit 11, which is provided for controlling the DC/DC converter 2 in response to the output of the bulb voltage detector 8, includes a turning point detecting unit 101 and a power control unit 102. The turning point detecting unit 101 is provided to detect a turning point from a constant voltage, which is a low voltage of the HID bulb voltage, to a stable voltage in response to the detected value fed from the bulb voltage detector 8. The power control unit 102 controls the output power of the HID bulb 7 in accordance with the turning point detected by the turning point detecting unit 101. The power control unit 102 controls the current flowing through the HID bulb 7 by controlling the duty factor of the DC/DC converter 2, for example.

Figure 2:
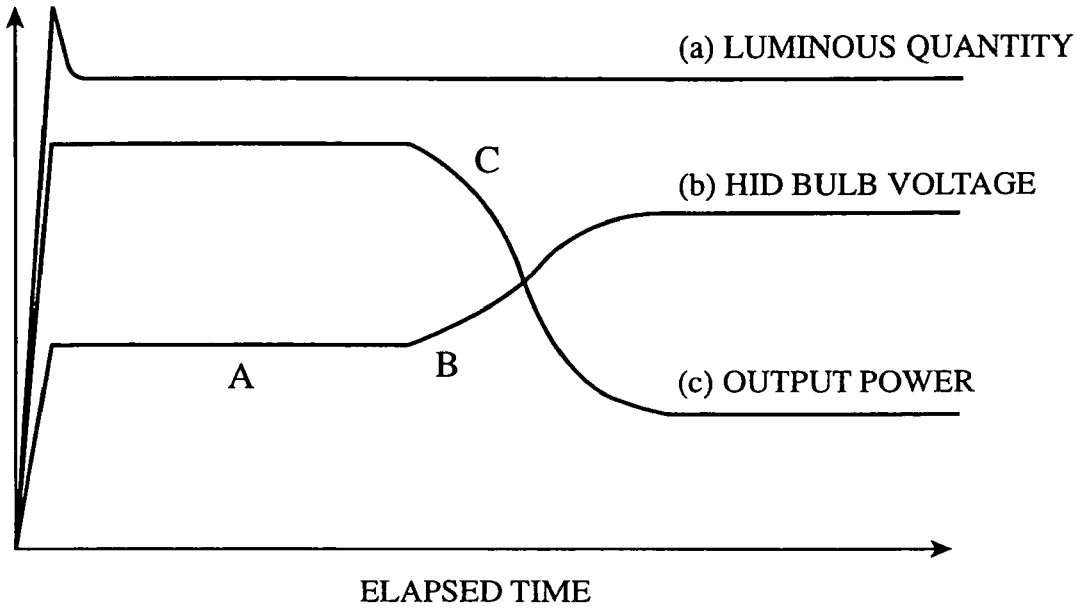
FIG. 2 is an output characteristic diagram illustrating the control operation of the embodiment 1 in accordance with the present invention.

FIG. 2 is a characteristic chart illustrating the control operation of the embodiment 1. FIG. 2 illustrates the HID bulb voltage, output power and light emitting characteristics of a combination of the present embodiment of the discharge bulb ballast and the HID bulb without using the mercury. In FIG. 2, (a) represents the luminous quantity; (b) represents the voltage of the HID bulb 7; and (c) represents the output power of the HID bulb.

While only the xenon gas emits light, the HID bulb voltage is approximately constant at 30 V, in which case the luminous quantity is approximately proportional to the output power, and its duration is approximately inversely proportional to the output power. Accordingly, to obtain bright light quickly, large power (first power) is continuously output as long as the approximately constant HID bulb voltage continues as illustrated by A of FIG. 2, thereby shortening the duration in which only the xenon gas emits light.

Subsequently, as the addition metals such as zinc and indium start to vaporize with the metal halides, the HID bulb voltage denoted by B of FIG. 2 starts to increase together with the luminous quantity. Thus, the output power denoted by C of FIG. 2 is reduced to curb the luminous quantity (supply of second power smaller than the first power). As the major light emission shifts to the metal halides, the attenuation of the output power is started, and the output power is decreased gradually to the rated power.

More specifically, the turning point detecting unit 101 detects the rising timing of the HID bulb voltage due to the start of the evaporation of the metal halides as the turning point, and the power control unit 102 carries out the control in such a manner that the output power is gradually reduced in accordance with the timing of the turning point.

Thus, the present embodiment is configured such that while only the xenon gas emits light immediately after switching on the light, it outputs the power large enough to gain the sufficiently high luminous quantity, and drops the output power immediately after the metal halides reach the period in which they evaporate and emit light. The control can implement the discharge bulb ballast applicable to the HID bulbs without using the mercury such as the onboard headlights requiring the sharp start-up of the luminous quantity and stable lighting.

Thus, to increase the luminous quantity quickly and smoothly and to achieve stable lighting, the present embodiment has such output power characteristics that output large power immediately after switching on the light, start to reduce the output power from the turning point at which the voltage of the HID bulb rises because of heating by the lighting (power supply), and gradually reduce the output power to the rated power, thereby enabling the HID bulb without using the mercury to light up quickly.

Such characteristics are implemented by focusing attention on the following two phenomena representing the characteristics of the HID bulb without using the mercury.

(1) While only the xenon gas emits light, the HID bulb voltage is approximately constant, and the luminous quantity is approximately proportional to the output power in spite of the low light emission efficiency.

(2) When the metal halides start to vaporize, the HID bulb voltage rises, and the luminous quantity increases simultaneously.

The timing at which the light emission of the xenon gas is switched to that of the metal halides is the point at which the foregoing state (1), in which the HID bulb voltage is approximately constant is changed to the state (2) in which the HID bulb voltage starts rising. Thus, as long as the voltage of the HID bulb is low and approximately constant, the large power is output to secure the necessary luminous quantity by the xenon gas only. Then, the attenuation of the output power is started from the turning point at which the voltage of the HID bulb rises sharply, followed by reducing the output power gradually to the rated power. In this way, the present embodiment can implement the output power characteristics enabling the lighting in the stable luminous quantity.

Embodiment 2

In the present embodiment, the turning point detecting unit 101 is composed of a differentiating circuit. The differentiating circuit can be composed of a dedicated piece of hardware, or of a program executed by a computer.

For example, a configuration is possible in which the control circuit 11 is composed of a computer, and the turning point detecting unit 101 and power control unit 102 are constructed by combining programs corresponding to their functions with the hardware such as a central processing unit and memory. The operation of the configuration is as follows.

Figure 3:
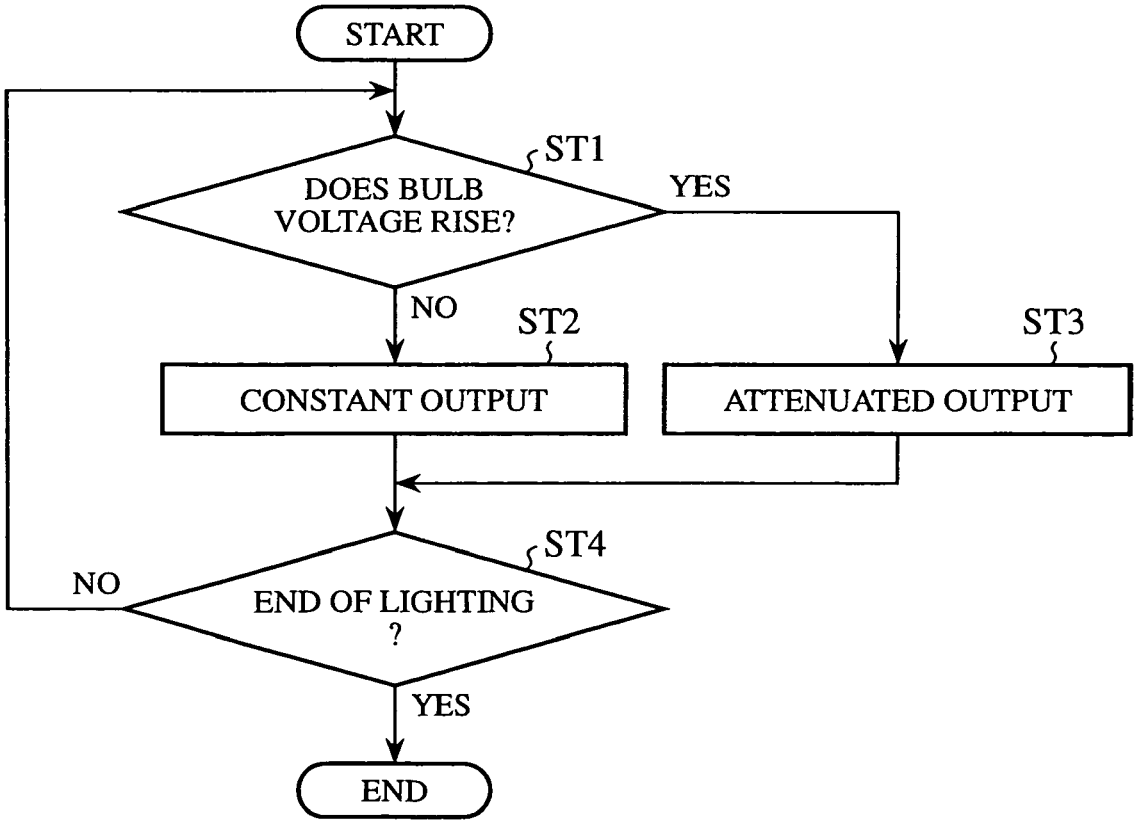
FIG. 3 is a flowchart illustrating the operation of the embodiment 2 in accordance with the present invention.

FIG. 3 is a flowchart illustrating the operation of the control circuit 11 composed of a computer.

First, the turning point detecting unit 101 makes a decision as to whether the HID bulb voltage is rising (step ST1). When the HID bulb voltage is not rising at step ST1, the processing proceeds to step ST2 at which the power control unit 102 controls the output power to become constant. The state corresponds to the HID bulb voltage at A of FIG. 2. In contrast, when the bulb voltage is rising at step ST1, the power control unit 102 controls the output power to be reduced (step ST3). The state corresponds to the HID bulb voltage at B of FIG. 2.

Subsequent to steps ST2 and ST3, the turning point detecting unit 101 makes a decision as to whether the HID bulb 7 terminates lighting, that is, whether the power is turned off. When the lighting continues, the processing is returned to step ST1 to continue the foregoing control operation. When the lighting is turned off, the control operation is brought to an end.

In this way, according to the differential output of the HID bulb voltage, the present embodiment detects the transition from the state immediately after switching on the light in which only the xenon gas emits light to the state in which the metal halides start light emission. Accordingly, it can detect the timing without fail at which the metal halides start light emission. As a result, the present embodiment can implement the discharge bulb ballast applicable to the HID bulbs without using the mercury, which are used as the onboard headlights requiring the sharp start-up of the luminous quantity and the stable lighting.

Embodiment 3

In the present embodiment 3, the turning point detecting unit 101 is configured such that it sets the turning point at 70% of the stable voltage that is defined as the voltage in the state in which the lighting of the HID bulb 7 becomes stable and the HID bulb voltage is made stable. Since the remaining configuration of the discharge bulb ballast including the power control unit 102 is the same as that of the embodiment 1 as shown in FIG. 1, the description thereof is omitted here.

Figure 4:
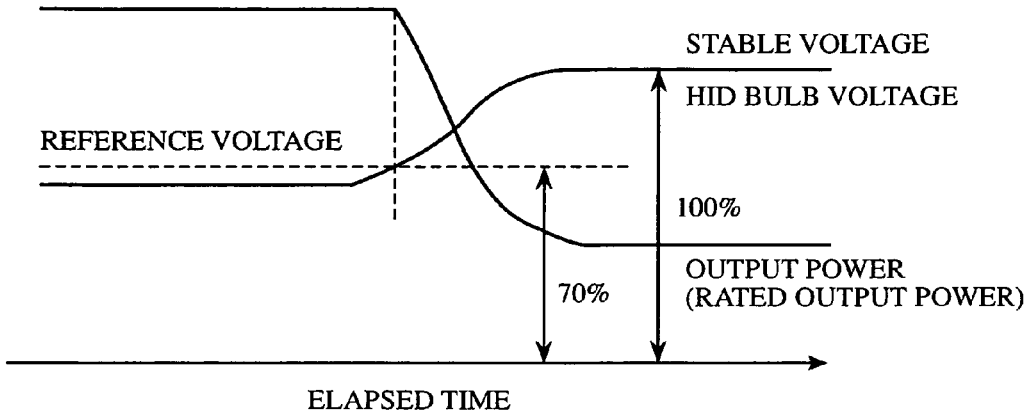
FIG. 4 is an output characteristic diagram illustrating the control operation of an embodiment 3 in accordance with the present invention.

FIG. 4 is a diagram illustrating the HID bulb voltage and output power characteristics in a combination of the embodiment 3 of the starter in accordance with the present invention and the HID bulb without using the mercury.

The voltages of the HID bulbs, which are determined according to the components and pressure of the internal gases, have individual difference. Thus, a fixed turning point cannot cope with the HID bulbs with the variations. In view of this, the present embodiment sets the turning point for detecting the rising of the voltage of the HID bulb at 70% of the voltage at which the HID bulb lights stably at the rated power. More specifically, the turning point detecting unit 101 stores as the stable voltage the HID bulb voltage at which the HID bulb 7 lights stably at the rated power by lighting it up in advance (by lighting up once). Then, it decides the timing at which the voltage of the HID bulb exceeds 70% of the stable voltage as the turning point. Using the voltage of that turning point as the reference voltage for the HID bulb voltage, the turning point detecting unit 101, monitoring the HID bulb voltage from the start of the lighting up and detecting that it exceeds the reference voltage, notifies the power control unit 102 of that fact. The power control unit 102 starts reducing the output power from the timing notified, and gradually decreases the output power to the rated power.

As for the stable voltage of the HID bulb 7, its first value can be set at a predetermined value, and its second and subsequent values can be obtained by storing the previous stable voltages. Although the specified ratio is determined at 70% of the stable voltage, the ratio can be varied appropriately.

As described above, the embodiment 3 is configured such that it determines the voltage of the turning point using the HID bulb voltage in the stable state. Accordingly, the present embodiment can determine the optimum turning point for the individual HID bulbs, even if the voltages of the HID bulbs have variations due to the individual difference. Thus, the present embodiment can detect the timing at which the metal halides start light emission without fail. As a result, it can implement the discharge bulb ballast applicable to the HID bulbs without using the mercury, which are used as the onboard headlights requiring the sharp start-up of the luminous quantity and the stable lighting.

Embodiment 4

In the embodiment 4, the turning point detecting unit 101 is configured such that it uses as the turning point the voltage obtained by adding a specified voltage to the constant voltage at which the HID bulb 7 lights immediately after switching on the light. Since the remaining configuration of the discharge bulb ballast including the power control unit 102 is the same as that of the embodiment 1 as shown in FIG. 1, the description thereof is omitted here.

Figure 5:
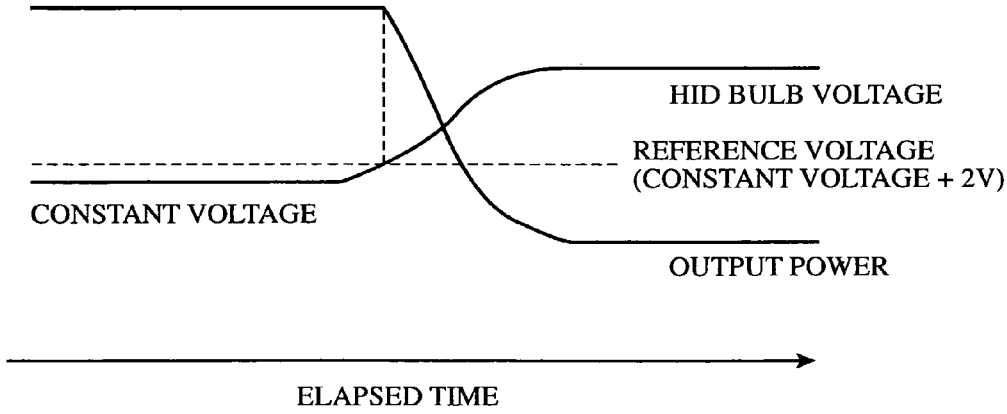
FIG. 5 is an output characteristic diagram illustrating the control operation of an embodiment 4 in accordance with the present invention.

FIG. 5 is a diagram illustrating the HID bulb voltage and output power characteristics in a combination of the embodiment 4 of the discharge bulb ballast in accordance with the present invention and the HID bulb without using the mercury.

The voltages of the HID bulbs, which are determined according to the components and pressure of the internal gases, have an individual difference. Thus, a fixed turning point (the reference voltage for the HID bulb voltage) cannot cope with the HID bulbs with the variations. In view of this, the turning point detecting unit 101 determines the turning point as follows. First, it employs the HID bulb voltage that is stored in advance while only the xenon gas emits light immediately after switching on the light as the constant voltage of the low voltage. Second, it obtains the turning point by adding a certain voltage (2 V, for example) to the constant voltage of the low voltage.

Then, using the voltage of the turning point as the reference voltage for the HID bulb voltage, the turning point detecting unit 101, monitoring the HID bulb voltage from the start of the lighting up and detecting that it exceeds the reference voltage, notifies the power control unit 102 of that fact. The power control unit 102 starts reducing the output power at the timing notified, and gradually decreases the output power to the rated power.

For example, when the constant voltage of the low voltage detected in the present embodiment is 30 V, the attenuation of the output power is started from the time at which the HID bulb voltage exceeds 32 V.

As for the constant voltage of the low voltage of the HID bulb 7, its first value can be set at a predetermined value, and its second and subsequent values can be obtained by storing the previous constant voltages. Although the foregoing example employs the voltage obtained by adding 2 V to the constant voltage as the voltage of the turning point, the value can be varied appropriately.

As described above, the embodiment 4 is configured such that it sets as the voltage of the turning point the voltage obtained by adding a predetermined voltage to the constant voltage of the low voltage of the HID bulb voltage. Accordingly, the present embodiment can determine the optimum turning point for the individual HID bulbs, even if the voltages of the HID bulbs have variations due to the individual difference. Thus, the present embodiment can detect the timing at which the metal halides start light emission without fail. As a result, it can implement the discharge bulb ballast applicable to the HID bulbs without using the mercury, which are used as the onboard headlights requiring the sharp start-up of the luminous quantity and the stable light emission.

Embodiment 5

In the embodiment 5, the turning point detecting unit 101 is configured such that it obtains as a minimum bulb voltage the least voltage among the sequentially detected HID bulb voltages immediately after switching on the light, and determines a value obtained by adding a predetermined voltage to the minimum bulb voltage as the voltage of the turning point. Since the remaining configuration of the discharge bulb ballast including the power control unit 102 is the same as that of the embodiment 1, the description thereof is omitted here.

Figure 6:
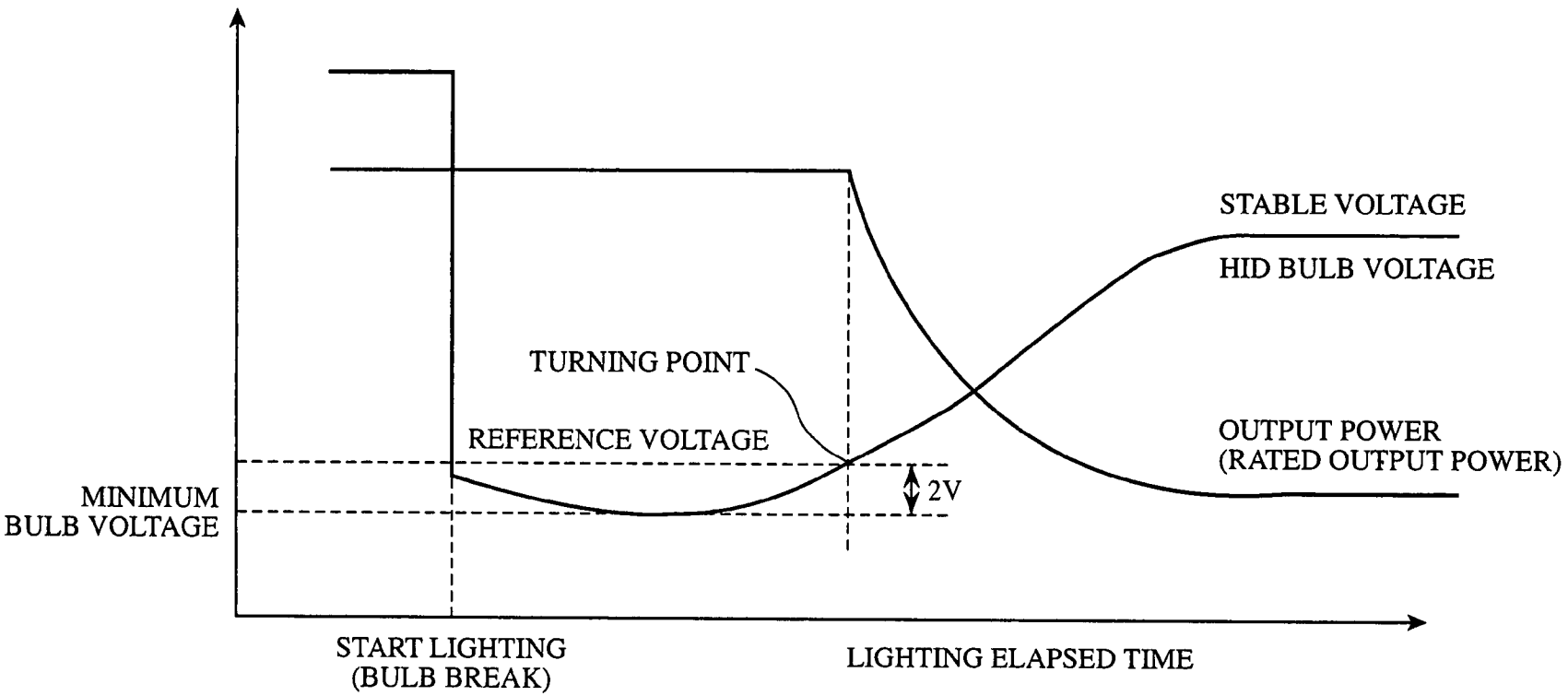
FIG. 6 is an output characteristic diagram illustrating the control operation of an embodiment 5 in accordance with the present invention.

FIG. 6 is a diagram illustrating the HID bulb voltage and output power characteristics in the embodiment 5 in accordance with the present invention.

After switching on the HID bulb 7 (bulb break), the turning point detecting unit 101 monitors the HID bulb voltage output from the bulb voltage detector 8 (the HID bulb voltage while the HID bulb is being lighted by the xenon gas). Then it decides the lowest HID bulb voltage in the monitoring period as the minimum bulb voltage. In addition, the turning point detecting unit 101 determines the value obtained by adding a predetermined voltage (2 V, for example) to the minimum bulb voltage as the voltage of the turning point, and supplies it to the power control unit 102. For example, when the minimum reference voltage detected is 30 V, 32 V is set as the voltage of the turning point.

Receiving the notification that the turning point is exceeded from the turning point detecting unit 101, the power control unit 102 starts to reduce the output power and gradually decreases the output power to the rated power as in the foregoing embodiments.

As described above, the embodiment 5 is configured such that it successively detects the HID bulb voltage immediately after switching on the light, obtains the minimum bulb voltage immediately after switching on the light, and sets the value obtained by adding the predetermined voltage to the minimum bulb voltage as the voltage of the turning point. Thus, the present embodiment can set the optimum turning points for the individual HID bulbs even if the voltages of the HID bulbs have variations due to the individual difference. Consequently, the present embodiment can detect the timing at which the metal halides start light emission without fail. As a result, it can implement the discharge bulb ballast applicable to the HID bulbs without using the mercury, which are used as the onboard headlights requiring the sharp start-up of the luminous quantity and the stable light emission.

Furthermore, since the minimum bulb voltage is detected at every lighting, and the turning point is set in accordance with the detected value, it is not necessary for the turning point detecting unit 101 to store information such as the previous turning point or the constant voltage of the low voltage. Therefore the discharge bulb ballast need not have a means for storing the previous turning point and the like, such as a nonvolatile memory. In addition, since the turning point is set at each lighting operation, the lighting control best suited for the HID bulb 7 can be carried out from the initial lighting of the HID bulb 7, which occurs when the onboard headlight is replaced.

Embodiment 6

In the embodiment 6, the turning point detecting unit 101 is configured such that it sets the minimum bulb voltage among the following three voltages as the turning point: (1) The voltage having a specified ratio to the stable voltage of the HID bulb voltage; (2) the voltage obtained by adding a predetermined voltage to the constant voltage of the low voltage immediately after switching on the light, which is stored in advance; and (3) the voltage which is obtained by finding the minimum bulb voltage among the HID bulb voltages successively detected immediately after switching on the light, and by adding a predetermined voltage to the minimum bulb voltage. Since the remaining configuration including the power control unit 102 is the same as that of the embodiment 1, the description thereof is omitted here.

Figure 7:
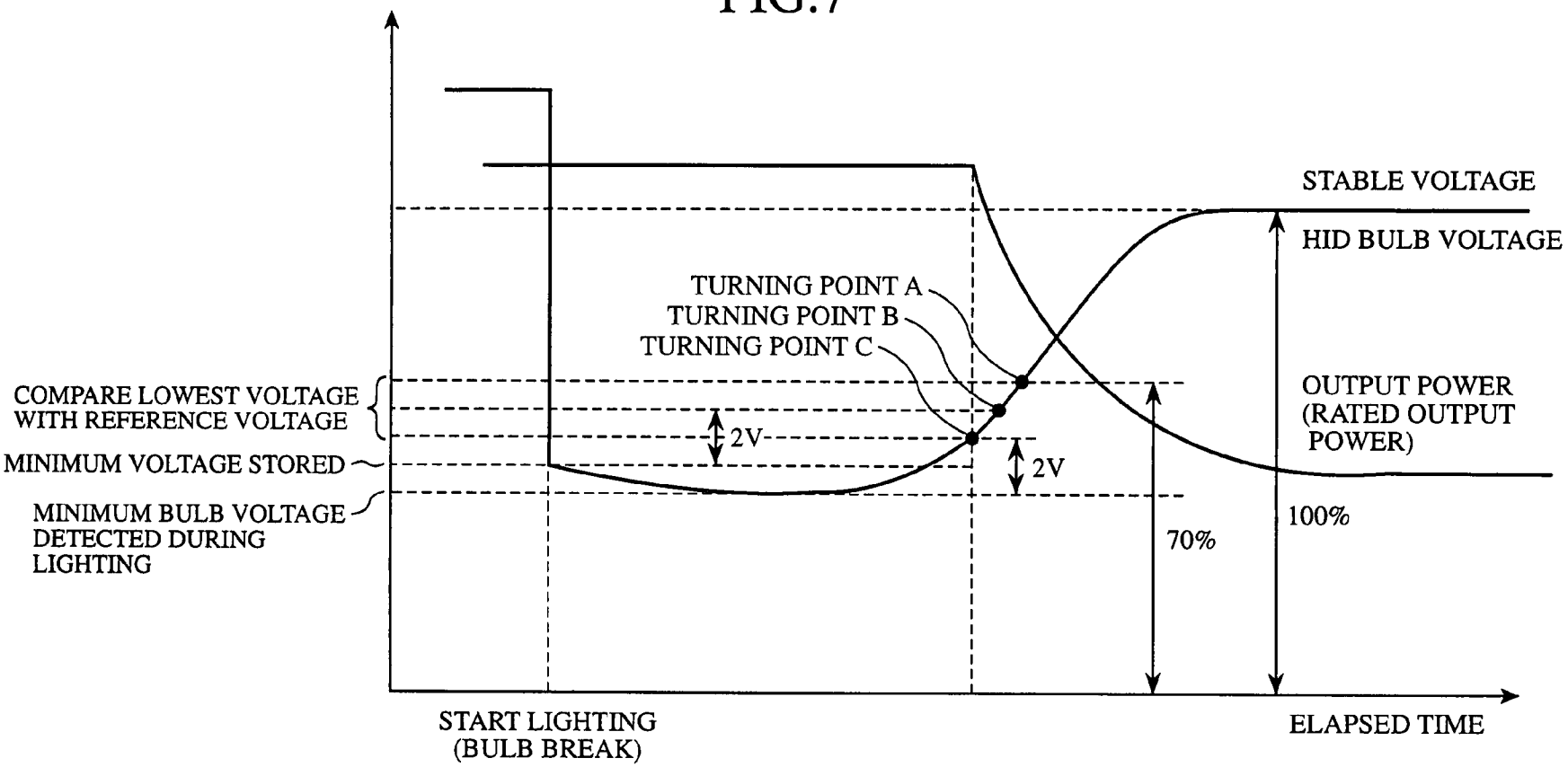
FIG. 7 is an output characteristic diagram illustrating the control operation of an embodiment 6 in accordance with the present invention.

FIG. 7 is a diagram illustrating the HID bulb voltage and output power characteristics in the embodiment 6 in accordance with the present invention.

In FIG. 7, the turning point A denotes the voltage equal to 70% of the stable voltage of the HID bulb voltage, which is obtained in the same manner as in the embodiment 3. The turning point B denotes the voltage obtained by adding 2 V to the voltage stored as the previous minimum voltage, which is obtained in the same manner as in the embodiment 4. The turning point C denotes the voltage obtained by adding 2 V to the minimum voltage from the start of the lighting, which is obtained in the same manner as in the embodiment 5.

The turning point detecting unit 101 stores the voltage of the turning point A and the voltage of the turning point B in advance. When the light is turned on, the voltage of the turning point C is obtained. Then the minimum voltage among the three voltages is set as the voltage (reference voltage) of the turning point. For example, when the voltage equal to 70% of the stable voltage (corresponding to the turning point A in FIG. 7) is 33 V, the voltage obtained by adding 2 V to the minimum voltage stored in advance (corresponding to the turning point B of FIG. 7) is 32 V, and the voltage obtained by adding 2 V to the minimum voltage detected immediately after switching on the light (corresponding to the turning point C of FIG. 7) is 31 V, the 31 V is set as the voltage of the turning point.

Receiving a notification that the HID bulb voltage exceeds the turning point from the turning point detecting unit 101, the power control unit 102 starts the attenuation of the output power in the same manner in the foregoing embodiments, and gradually decreases the output power to the rated power.

As described above, the embodiment 6 is configured such that it sets as the voltage of the turning point the minimum voltage among (1) the voltage having a specified ratio to the stable voltage of the HID bulb voltage, (2) the voltage obtained by adding the predetermined voltage to the previous minimum voltage, and (3) the voltage which is obtained by adding the predetermined voltage to the minimum bulb voltage immediately after switching on the light. Thus, the present embodiment offers the following advantages.

The present embodiment can set the optimum turning points for the individual HID bulbs even if the voltages of the HID bulbs have variations due to the individual difference. Consequently, the present embodiment can detect the timing at which the metal halides start light emission without fail. As a result, it can implement the discharge bulb ballast applicable to the HID bulbs without using the mercury, which are used as the onboard headlights requiring the sharp start-up of the luminous quantity and the stable light emission.

In addition, since the present embodiment sets the turning point in accordance with the values of the foregoing (1)–(3), it can carry out the optimum lighting control under any circumstances. For example, it can perform the lighting control best suited for the onboard headlights in such cases as the initial lighting after the replacement of the bulb, and turning on the light in such a condition as the initial state is not yet recovered completely after turning off the light.

Embodiment 7

In the embodiment 7, the turning point detecting unit 101 is configured such that it uses as the turning point the voltage obtained by adding a predetermined voltage to the constant voltage of the low voltage at which the HID bulb 7 lights immediately after switching on the light.

In addition, as in the foregoing embodiments, the power control unit 102 is configured such that it gradually reduces the output power in response to the timing of the turning point output from the turning point detecting unit 101, and that it stores the stable voltage of the HID bulb 7 (42 V, for example), and regulates the output power to a constant value when the HID bulb voltage reaches the stable voltage.

Figure 8:
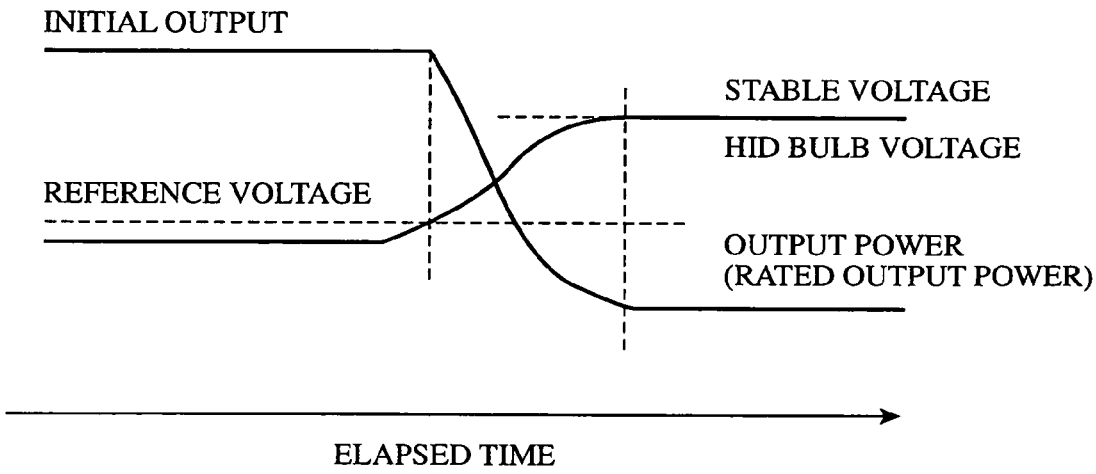
FIG. 8 is an output characteristic diagram illustrating the control operation of an embodiment 7 in accordance with the present invention.

FIG. 8 is a diagram illustrating relationships between the HID bulb voltage and output power of the embodiment 7.

Assuming that the HID bulb voltage is a constant value (30 V in this case) while the HID bulb is lighting by the xenon gas, the turning point detecting unit 101 adds a certain margin (2 V in this case) to the constant value, thereby obtaining the voltage of the turning point (32 V in this case). In the embodiment 7, the voltage of the turning point can also be calculated from the constant voltage of the low voltage that is obtained for each HID bulb 7 as in the embodiment 4.

The turning point detecting unit 101 compares the HID bulb voltage of the HID bulb 7 fed from the bulb voltage detector 8 with the voltage of the turning point (reference voltage). When the HID bulb voltage exceeds the reference voltage, it notifies the power control unit 102 of that fact.

Receiving the notification, the power control unit 102 starts control to reduce the output power, and continues the attenuation control until the HID bulb voltage reaches the prestored stable voltage (the rated voltage (42 V) during the lighting by the metal halides). Once the HID bulb voltage has reached the stable voltage, the power control unit 102 carries out the control for regulating the output power at the constant value.

As described above, the embodiment 7 is configured such that it holds the stable voltage value of the HID bulb voltage, and carries out the attenuation control of the output power up to the stable voltage from the voltage of the turning point which is obtained by adding the predetermined value to the constant voltage of the low voltage. Thus, the present embodiment has the following advantages.

The present embodiment can detect the timing of transition from the state in which only the xenon gas emits light immediately after switching on the light to the state in which the metal halides start the light emission without fail, and output sufficiently large power in the state in which only the xenon gas emits light. In addition, after the metal halides vaporize to start light emission, it can reduce the output power immediately. Furthermore, it can carry out smooth output power control even in a region where the HID bulb voltage is close to the stable voltage. Accordingly, the present embodiment can implement the discharge bulb ballast applicable to the HID bulbs without using the mercury, which are used as the onboard headlights requiring the sharp start-up of the luminous quantity and the stable light emission with little fluctuations.

Embodiment 8

In the embodiment 8, the power control unit 102 is configured such that it controls, from the voltage corresponding to the turning point, the output power in accordance with a predetermined relationship between the HID bulb voltage and the output power. Since the remaining configuration of the discharge bulb ballast including the turning point detecting unit 101 is the same as that of the foregoing embodiments, the description thereof is omitted here.

Figure 9:
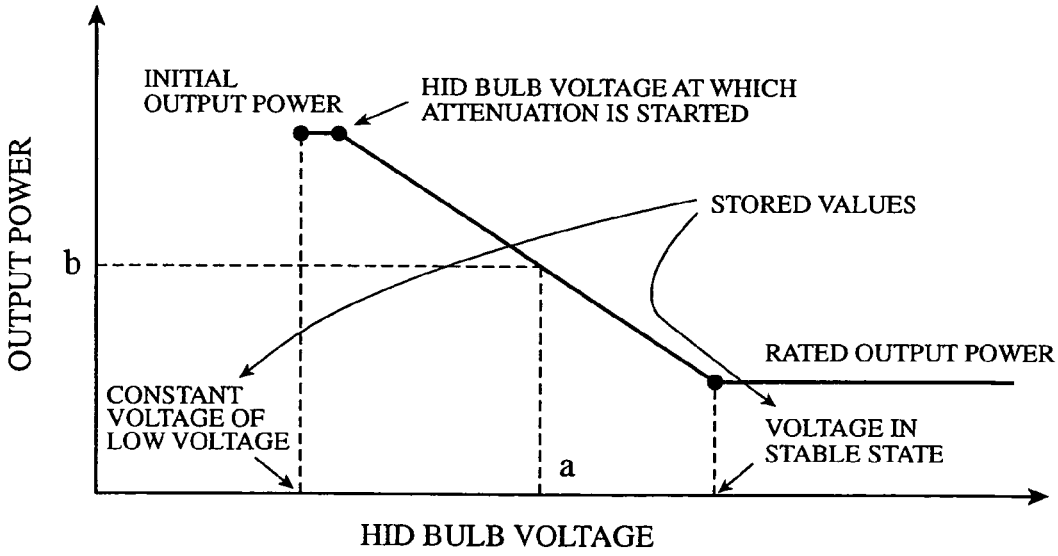
FIG. 9 is an output characteristic diagram illustrating the control operation of an embodiment 8 in accordance with the present invention.

FIG. 9 is a diagram illustrating the relationship between the HID bulb voltage and output power by Cartesian coordinates. As shown in FIG. 9, the relationship between the components is determined in advance in such a fashion that the HID bulb voltage a corresponds to the output power b. The relationship is represented by a line connecting the following two points: a point indicating the HID bulb voltage and output power at which the power attenuation is started (the HID bulb voltage and output power corresponding to the turning point); and a point indicating the HID bulb voltage during the stable lighting (stable voltage) and the rated power.

The power control unit 102 stores the information on the relationship between the HID bulb voltage and output power. When it receives the notification that the HID bulb voltage exceeds the turning point from the turning point detecting unit 101, it carries out the attenuation control of the output power in accordance with the relationship between the HID bulb voltage and output power.

Although the characteristics are varied linearly between the two points in the foregoing description, they can be varied curvedly or stepwise.

As described above, the embodiment 8 is configured such that the power control unit 102 controls the output power in accordance with the predetermined relationship between the HID bulb voltage and the output power from the turning point. Thus, it offers the following advantages.

It can output sufficiently large power in the state in which only the xenon gas emits light, and output appropriate power during the period in which the metal halides evaporate to emit light. In addition, since it carries out the attenuation control in accordance with the relationship between the HID bulb voltage and output power as illustrated in FIG. 9, it can perform precise control. As a result, it can keep the luminous quantity of the HID bulb 7 constant even during the control. Accordingly, the present embodiment can implement the discharge bulb ballast applicable to the HID bulbs without using the mercury, which are used as the onboard headlights requiring the sharp start-up of the luminous quantity and the stable light emission with little fluctuations.

Embodiment 9

In the embodiment 9, the power control unit 102 is configured such that it starts the attenuation control in response to the turning point, and then controls the output power in accordance with a predetermined relationship between the lighting elapsed time and the output power. Since the remaining configuration of the discharge bulb ballast including the turning point detecting unit 101 is the same as that of the foregoing embodiments, the description thereof is omitted here.

Figure 10:
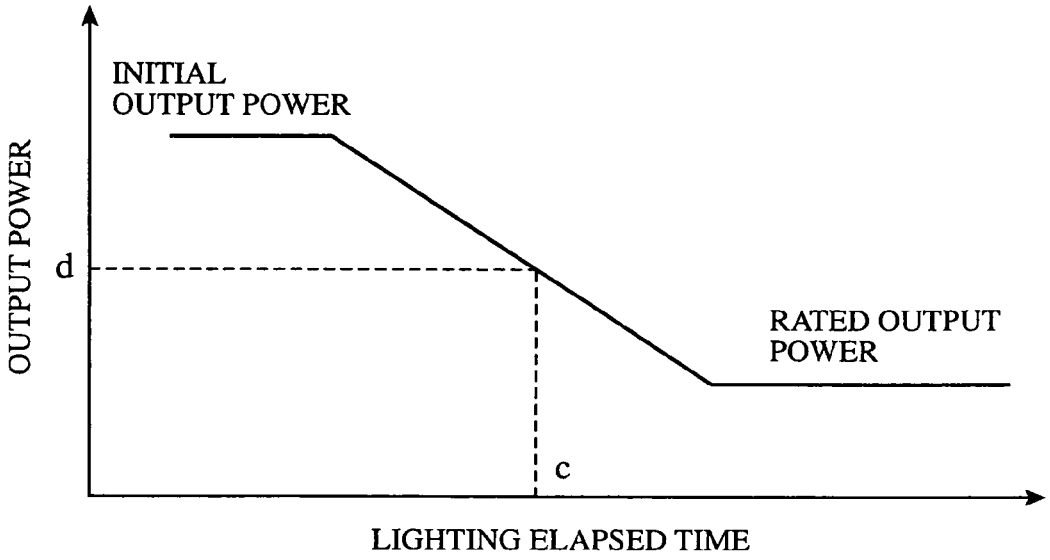
FIG. 10 is an output characteristic diagram illustrating the control operation of an embodiment 9 in accordance with the present invention.

FIG. 10 is a diagram illustrating a relationship between the lighting elapsed time and output power by Cartesian coordinates. As shown in FIG. 10, the relationship between the components is determined in such a fashion that the lighting elapsed time c corresponds to the output power d. The relationship is represented by a line connecting the following two points: a point indicating the lighting elapsed time and output power at which the power attenuation is started (the lighting elapsed time and output power corresponding to the turning point); and a point indicating the rated output power and the lighting elapsed time.

The power control unit 102 stores the information on the relationship between the lighting elapsed time and output power. When it receives the notification that the turning point is reached from the turning point detecting unit 101, it carries out the control of the output power in accordance with the relationship between the lighting elapsed time and output power.

Although the characteristics are varied linearly according to the lighting elapsed time in the foregoing description, they can be varied curvedly or stepwise.

As described above, the embodiment 9 is configured such that the power control unit 102 controls the output power in accordance with the predetermined relationship between the lighting elapsed time and the output power after starting the attenuation control. Thus, it offers the following advantages.

It can output sufficiently large power during the period in which only the xenon gas emits light, and output appropriate power during the period in which the metal halides evaporate to emit light. Accordingly, it can implement the discharge bulb ballast applicable to the HID bulbs without using the mercury, which are used as the onboard headlights requiring the sharp start-up of the luminous quantity and the stable light emission with little fluctuations. In addition, since it carries out the attenuation control independently of the HID bulb voltage, it can perform the precise attenuation control of the output power even if the stable voltage of the HID bulb 7 fluctuates.

Embodiment 10

In the embodiment 10, the power control unit 102 is configured such that it holds information on the predetermined relationship between the HID bulb voltage and the output power and has the HID bulb voltage value corresponding to the turning point, and that when the HID bulb voltage exceeds the HID bulb voltage corresponding to the turning point, it starts the attenuation control from the output power corresponding to that HID bulb voltage.

Since the remaining configuration of the discharge bulb ballast including the turning point detecting unit 101 is the same as that of the foregoing embodiments, the description thereof is omitted here.

Figure 11:
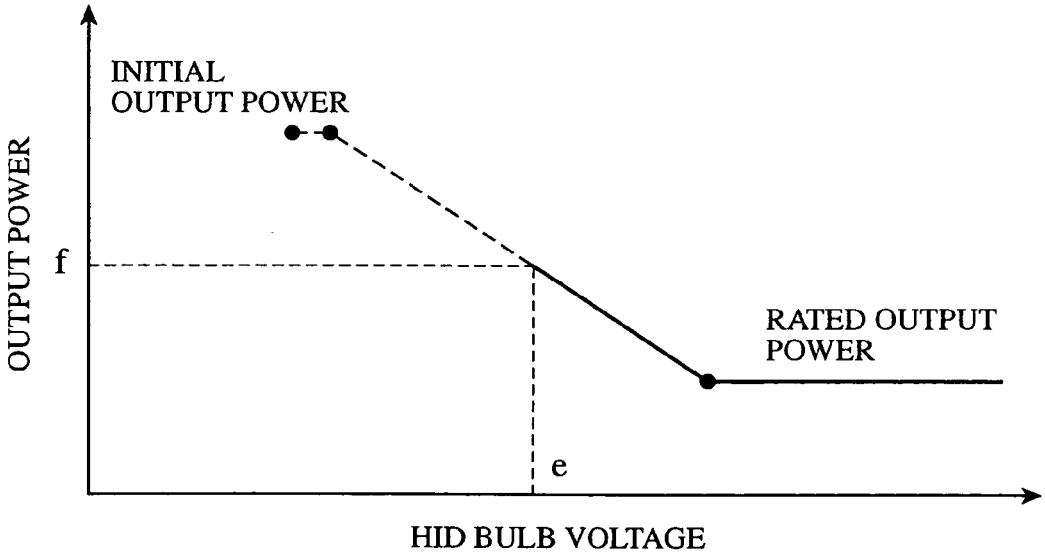
FIG. 11 is an output characteristic diagram illustrating the control operation of an embodiment 10 in accordance with the present invention.

FIG. 11 is a diagram illustrating the relationship between the HID bulb voltage and output power by Cartesian coordinates. As shown in FIG. 11, the relationship between the components is determined in advance in such a fashion that the HID bulb voltage e corresponds to the output power f. The line is the same as that of the embodiment 8 as shown in FIG. 9.

The power control unit 102 stores the information on the relationship between the HID bulb voltage and output power, and the value of the HID bulb voltage corresponding to the turning point. Accordingly, it can carry out the precise attenuation control of the output power, even if the HID bulb voltage immediately after switching on the light is greater than the voltage of the turning point as in a case where the HID bulb 7 is turned off, and then turned on again immediately after that.

Although the characteristics are varied linearly between the two points in the foregoing description, they can be varied curvedly or stepwise as in the embodiment 8.

As described above, the embodiment 10 is configured such that when the HID bulb voltage at the start of lighting is greater than the voltage corresponding to the turning point, the power control unit 102 carries out the attenuation control from the output power corresponding to the HID bulb voltage. Thus, it offers the following advantages.

It can carry out the precise attenuation control of the output power even if the HID bulb voltage immediately after switching on the light exceeds the turning point. As a result, it can output appropriate power even in a case where the metal halides are vaporized to emit light because of the repetition of the switching off and on. Accordingly, the present embodiment can implement the discharge bulb ballast applicable to the HID bulbs without using the mercury, which are used as the onboard headlights requiring the sharp start-up of the luminous quantity and the stable light emission with little fluctuations.

Embodiment 11

In the embodiment 11, the power control unit 102 is configured such that it has information on the relationship between the HID bulb voltage value corresponding to the turning point and the lighting elapsed time corresponding to the HID bulb voltage, together with the information on the relationship of the output power for the lighting elapsed time; and that when the HID bulb voltage immediately after switching on the light is greater than the HID bulb voltage corresponding to the turning point, the power control unit 102 obtains the lighting elapsed time corresponding to the HID bulb voltage, starts the attenuation control from the value of the output power corresponding to the lighting elapsed time, and carries out the control in accordance with the relationship between the lighting elapsed time and output power thereafter.

Since the remaining configuration of the discharge bulb ballast including the turning point detecting unit 101 is the same as that of the foregoing embodiments, the description thereof is omitted here.

Figure 12:
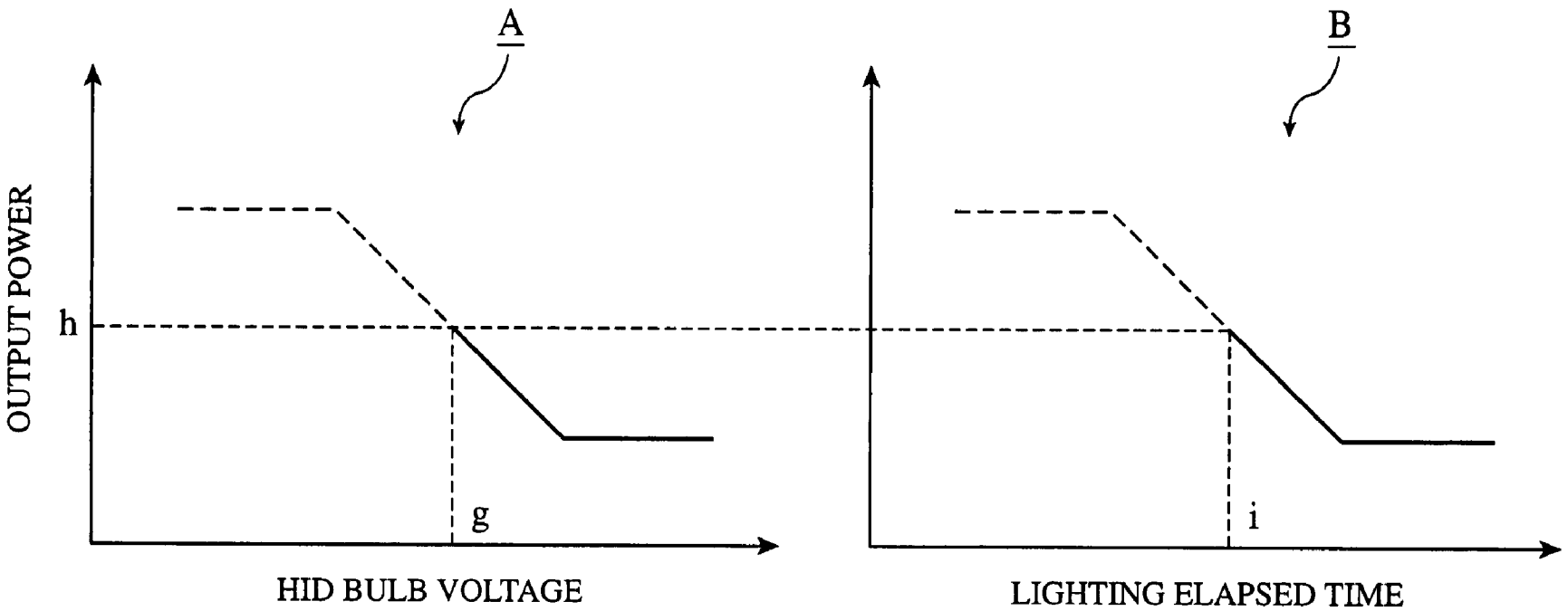
FIG. 12 is an output characteristic diagram illustrating the control operation of an embodiment 11 in accordance with the present invention.

FIG. 12 is a diagram illustrating the operation of the embodiment 11. In FIG. 12, the symbol A designates the relationship between the HID bulb voltage and output power, and B designates the relationship between the lighting elapsed time and output power.

Referring to FIG. 12, the operation will be described in which the lighting is started from the state in which the HID bulb voltage immediately after switching on the light exceeds the voltage of the turning point because of the repetitive switching off and on of the HID bulb 7.

First, the power control unit 102 calculates the value of the output power from the HID bulb voltage in accordance with the linear output power characteristics representing the HID bulb voltage and output power at which the ordinary attenuation is started (A of FIG. 12). For example, it calculates the output power h from the voltage g immediately after switching on the light. Subsequently, using the output power h, it calculates the lighting elapsed time corresponding to the lighting elapsed time after starting the attenuation from the output power characteristics representing the ordinary lighting elapsed time and output power by lines (B of FIG. 12). For example, it calculates the lighting elapsed time i corresponding to the output power h. Then, assuming that the lighting elapsed time i has already been passed, the power control unit 102 carries out the attenuation in accordance with the output power characteristics, which represent the lighting elapsed time and output power after starting the ordinary attenuation by the lines, and performs the control to the rated power.

As described above, the embodiment 11 makes a decision as to whether the HID bulb voltage exceeds the voltage of the turning point, first. When exceeds, it calculates the value of the output power corresponding to the HID bulb voltage. Subsequently, it obtains the value of the lighting elapsed time corresponding to the output power, and carries out the attenuation control in accordance with the relationship between the lighting elapsed time and output power from the value of the output power corresponding to the lighting elapsed time. Thus, it offers the following advantages.

It can carry out the precise attenuation control of the output power even if the HID bulb voltage immediately after switching on the light exceeds the turning point. As a result, it can output appropriate power even in a case where the metal halides are vaporized to emit light because of the repetition of the switching off and on. Accordingly, the present embodiment can implement the discharge bulb ballast applicable to the HID bulbs without using the mercury, which are used as the onboard headlights requiring the sharp start-up of the luminous quantity and the stable light emission with little fluctuations.

In addition, since the present embodiment carries out the attenuation control in accordance with the relationship between the lighting elapsed time and output power, it offers an advantage of being able to perform the precise attenuation control of the output power, even if the stable voltage of the HID bulb 7 fluctuates, for example.

Although the embodiments are described by way of example of the HID bulb without using the mercury, this is not essential. For example, the discharge bulb ballast applied to the HID bulb using the mercury can speed up the start-up of the luminous quantity and achieve the stable luminous quantity. However, the foregoing advantages are particularly great when the discharge bulb ballast is applied to the bulb without using the mercury, the so-called mercury-less bulb.

INDUSTRIAL APPLICABILITY

As described above, the discharge bulb ballast in accordance with the present invention is applicable to the HID bulbs without using the mercury, which are employed as the onboard headlights, and is suitable to carry out the sharp start-up of the luminous quantity and stable lighting with little fluctuations by such HID lamps.

What is claimed is:

1. A discharge bulb ballast including a power supply circuit for supplying power to a discharge bulb, an ignition circuit for applying a high voltage pulse to start discharge of the discharge bulb, and a control circuit for controlling power supplied by said power supply circuit and ignition circuit, said control circuit of said discharge bulb ballast comprising:

a turning point detecting unit for detecting a turning point at which a voltage of said discharge bulb starts to rise after said discharge bulb is switched on; and a power control unit for supplying first power after said discharge bulb is switched on, and for supplying second power lower than the first power when said turning point detecting unit detects the turning point.

2. The discharge bulb ballast according to claim 1, wherein said turning point detecting unit comprises a differentiating circuit.

3. The discharge bulb ballast according to claim 1, wherein said turning point detecting unit defines as a stable voltage a voltage of said discharge bulb in a stable lighting state at rated power, and sets a voltage value having a specified ratio to the stable voltage as the turning point, and wherein when said turning point detecting unit detects the turning point, said power control unit starts attenuation of output power, and gradually reduces an output power to the rated power.

4. The discharge bulb ballast according to claim 1, wherein said turning point detecting unit employs as the turning point a voltage value obtained by adding a predetermined voltage to a voltage of said discharge bulb that is lighting at a constant voltage immediately after switching on the light, and wherein when said turning point detecting unit detects the turning point, said power control unit starts attenuation of output power, and gradually reduces an output power to rated power.

5. The discharge bulb ballast according to claim 1, wherein said turning point detecting unit detects a lowest voltage among discharge bulb voltages successively detected immediately after switching on the light as a minimum bulb voltage, and employs a voltage value obtained by adding a predetermined voltage to the minimum bulb voltage as the turning point, and wherein when said turning point detecting unit detects the turning point, said power control unit starts attenuation of output power, and gradually reduces an output power to rated power.

6. The discharge bulb ballast according to claim 1, wherein said turning point detecting unit employs as the turning point a lowest voltage among three voltages consisting of a first voltage having a specified ratio to a stable voltage which is defined as a voltage of said discharge bulb in a stable lighting state at rated power, a second voltage obtained by adding a predetermined voltage to a voltage of said discharge bulb lighting at a constant voltage immediately after switching on the light, and a third voltage obtained by adding a predetermined voltage to a minimum bulb voltage which is detected as a lowest voltage among discharge bulb voltages successively detected immediately after switching on the light, and wherein when said turning point detecting unit detects the turning point, said power control unit starts attenuation of output power, and gradually reduces an output power to the rated power.

7. The discharge bulb ballast according to claim 1, wherein said turning point detecting unit employs as the turning point a voltage value obtained by adding a predetermined voltage to a voltage of said discharge bulb that is lighting at a constant voltage immediately after switching on the light, and said power control unit has a voltage of said discharge bulb in a stable lighting state at rated power as a stable voltage, and wherein when said turning point detecting unit detects the turning point, said power control unit starts attenuation of output power, and gradually reduces an output power until said discharge bulb reaches the stable phase.

8. The discharge bulb ballast according to claim 1, wherein when said turning point detecting unit detects the turning point, said power control unit starts attenuation of output power, and gradually reduces from the voltage corresponding to the turning point the output power to rated power in accordance with a predetermined relationship between the discharge bulb voltage and the output power.

9. The discharge bulb ballast according to claim 1, wherein when said turning point detecting unit detects the turning point, said power control unit starts attenuation of output power, and gradually reduces from the voltage corresponding to the turning point the output power to rated power in accordance with a predetermined relationship between a lighting elapsed time and the output power.

10. The discharge bulb ballast according to claim 1, wherein said power control unit holds information on a predetermined relationship between the discharge bulb voltage and output power, and has a discharge bulb voltage value corresponding to the turning point, and wherein when the discharge bulb voltage immediately after switching on the light exceeds the discharge bulb voltage value corresponding to the turning point, said power control unit starts attenuation of the output power from a value of the output power corresponding to the discharge bulb voltage in accordance with the information, and gradually reduces an output power to rated power.

11. The discharge bulb ballast according to claim 1, wherein said power control unit has a discharge bulb voltage value corresponding to the turning point, information on a relationship between the discharge bulb voltage and a lighting elapsed time, and information on a relationship between the lighting elapsed time and output power, and wherein when the discharge bulb voltage immediately after switching on the light exceeds the discharge bulb voltage value corresponding to the turning point, said power control unit obtains the lighting elapsed time corresponding to the discharge bulb voltage in accordance with the information on the relationship between the discharge bulb voltage and lighting elapsed time, starts attenuation of the output power from a value of the output power corresponding to the lighting elapsed time obtained in accordance with the information on the relationship between the lighting elapsed time and output power, and gradually reduces an output power to rated power.

* * * * *